United States Patent [19]

Yeaple et al.

[11] Patent Number: 4,604,028

[45] Date of Patent: Aug. 5, 1986

[54] INDEPENDENTLY ACTUATED CONTROL VALVES FOR STEAM TURBINE

[75] Inventors: Thomas L. Yeaple, Lynn; James B. Wagner, Peabody; Donald H. Hall, Middleton, all of Mass.

[73] Assignee: General Electric Company, Lynn, Mass.

[21] Appl. No.: 731,691

[22] Filed: May 8, 1985

[51] Int. Cl.[4] ..... F01D 17/18

[52] U.S. Cl. ..... 415/38; 415/44

[58] Field of Search ..... 415/38, 44, 155

[56] References Cited

U.S. PATENT DOCUMENTS

| | | | |
|---|---|---|---|
| 811,249 | 1/1906 | Samuelson | 415/38 |
| 915,716 | 3/1909 | Wilkinson | 415/44 |
| 3,350,061 | 10/1967 | Strass | 415/155 X |
| 3,828,814 | 8/1974 | Neumann et al. | 415/155 |
| 4,082,115 | 4/1978 | Gibb et al. | 91/368 |
| 4,325,670 | 4/1982 | Silvestri, Jr. | 415/38 X |

FOREIGN PATENT DOCUMENTS

| | | | |
|---|---|---|---|
| 834534 | 2/1970 | Canada | 415/44 |
| 4415 | 10/1979 | European Pat. Off. | 415/38 |

*Primary Examiner*—Leonard E. Smith

*Attorney, Agent, or Firm*—James W. Mitchell

[57] ABSTRACT

A control system for a steam turbine employs complementary-sized nozzle groups receiving steam in a sequence which employs the smallest possible sized group receiving steam from a control valve of the smallest possible capacity as the governing valve. All other control valves remain either fully open or fully closed. An optimum path may be followed to select a highest-efficiency transition between valve combinations.

1 Claim, 7 Drawing Figures

INDEPENDENTLY ACTUATED CONTROL VALVES FOR STEAM TURBINE

BACKGROUND OF THE INVENTION

The present invention relates to steam turbines and, more particularly, to a valve system for controlling steam turbines.

The output torque of steam turbines is conventionally controlled by a set of control valves which are opened in a fixed sequence by a sequential cam-operated mechanical controller. Such a sequential cam-operated controller is disclosed in U.S. Pat. No. 4,082,115, the disclosure of which is herein incorporated by reference.

A partially opened control valve for a steam turbine produces a pressure drop thereacross which adversely affects the efficiency of the steam turbine. Such a control valve is at its most efficient when it is fully open. In addition, the smaller the flow capacity of a fully open control valve, the less its inefficiency. The above referenced cam-operated control valve partially solves the efficiency problem by separating the required valve capacity into a plurality of substantially equally sized smaller valves. The valves are opened in sequence, with one valve at a time being varied to govern the flow and all of the others either fully opened or fully closed (except for a slight transition overlap during which one valve is not quite in the fully opened condition but is no longer considered to be exercising effective control over the steam flow). Thus, at most, the inefficiency experienced is only that due to a single one of the plurality of control valves.

A valve characteristic of conventional control valves produces a non-linear relationship between valve position and steam flow. The mechanically driven cams of the above-referenced sequential control valve system are shaped to compensate for the valve characteristic whereby a given increment of rotation of the set of cams produces a linear increment of change in steam flow.

Although the sequential cam-driven control valve system of the prior art exhibits improved partial-load efficiency over a single large control valve, the rigid sequential operation of such a control valve system requires that all of the control valves have substantially equal flow capacities.

U.S. Pat. No. 4,325,670 discloses a valving system for a steam turbine which employes unequal valve sizes actuated in a sequence which improves efficiency. The operating sequence in the referenced patent permits simultaneous governing by two valves and fails to disclose a method for always using the smallest-capacity one of the available control valves.

OBJECTS AND SUMMARY OF THE INVENTION

Accordingly it is an object of the invention to provide a valve control system for a steam turbine which overcomes the drawbacks of the prior art.

It is a further object of the invention to provide an independently actuated control valve system for a steam turbine which increases the efficiency of the steam turbine.

It is a still further object of the invention to provide an independently actuated control valve system for a steam turbine in which a plurality of control valves includes different flow capacities.

It is a still further object of the invention to provide an independently actuated control valve system for a steam turbine in which a plurality of control valves are operated in a sequence providing an improved efficiency.

It is a still further object of the invention to provide a control valve system for a steam turbine having a valve-control sequence in which nozzles for all opened valves are adjacent to each other.

Briefly stated, the present invention provides a control system for a steam turbine employing complementary-sized nozzle groups receiving steam in a sequence which employs the smallest possible control valve as the governing or modulating valve, supplying steam to the nozzle group having the smallest possible number of nozzles. All control valves other than the governing control valve remain either fully open or fully closed. An optimum path may be followed to select a highest-efficiency transition between valve combinations.

According to an embodiment of the invention, there is provided a steam turbine system comprising a steam turbine, a control valve system for feeding steam to said steam turbine, at least first, second and third nozzle groups in said steam turbine, said control valve system including at least first, second and third control valves for independently controlling an admission of steam to said first, second and third nozzle groups respectively, said first nozzle group having a substantially smaller number of nozzles than either of said second and third nozzle groups, a control system, said control system including means for producing at least first, second and third independent control signals for controlling said at least first, second and third control valves, respectively, and said control system further including means for controlling said first control valve in a governing condition while controlling at least said third control valve in one of a fully open and a fully closed condition.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
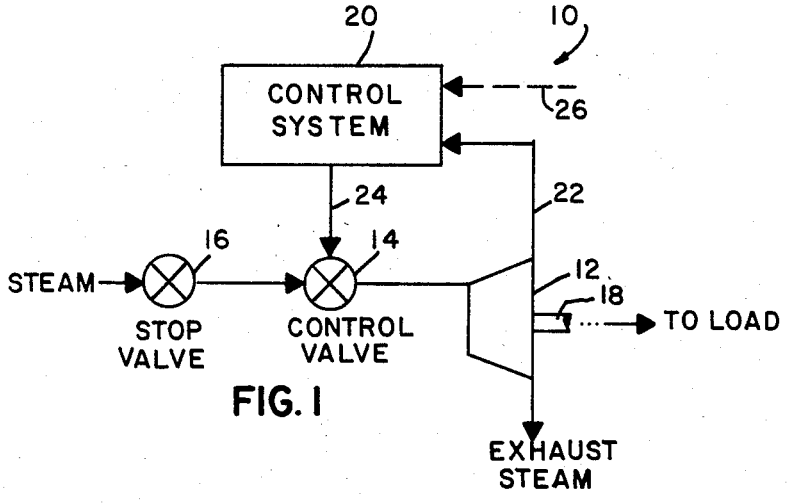
FIG. 1 is a simplified schematic diagram of a steam turbine system incorporating a control valve system according to an embodiment of the invention.

Referring first to FIG. 1, a steam turbine system, shown generally at 10, includes a steam turbine 12 driven by steam fed to it through a control valve system 14. As is conventional, control valve system 14 may receive its supply of steam from a stop valve 16 which is not of concern to the present disclosure. Mechanical output torque from steam turbine 12 is connected from a rotor 18 to a load (not shown).

The amount of steam admitted to steam turbine 12 by control valve system 14 controls the torque developed on rotor 18. The amount of steam is controlled, in turn, by a control system 20 which responds to a signal fed back from steam turbine 12 on a line 22 to generate control signals which are fed to control valve system 14 on a line 24. The signal fed from steam turbine 12 back on line 22 may vary according to the apparatus with which steam turbine system 10 is used. The signal on line 22 may be, for example, a tachometer signal responsive to the speed of rotor 18. Another type of signal on line 22 may represent a steam flow or other measure of the operation of steam turbine 12. Alternatively, the feedback signal, instead of being taken directly from steam turbine 12, may be derived from a load (not shown) being driven by steam turbine system 10. For example, if the load driven by steam turbine system 10 is an electric generator, a feedback signal representing the voltage, frequency or phase of the electrical output of the electric generator may be fed back on a line 26 (shown in dashed line) to control system 20.

In the prior art, control valve system 14 consists of a plurality of equally sized control valves each feeding an equal number of nozzles (not shown) in steam turbine 12. Control valve system 14 is a cam-driven mechanical actuator which increases the steam flow through control valve system 14 by driving the individual control valves from fully closed to fully open one at a time in a fixed sequence. The shape of the cams compensates for the non-linear valve characteristic in order to provide a linear relationship between cam rotation and steam flow. The one of the individual control valves being varied at any time governs or modulates the amount of steam flowing through control valve system 14. During acceleration and loading of steam turbine 12, once one of the individual valves is fully open, it remains fully open while the next control valve in the sequence assumes the task of governing or modulating the steam flow. Deceleration or unloading of steam turbine 12 is the reverse of acceleration. That is, the individual control valves in steam turbine 12 are closed in a fixed sequence which is the inverse of the opening sequence.

Most efficient operation of steam turbine 12 takes place at full rated capacity or at other design capacity in which any of the individual control valves in control valve system 14, which are open, are fully open. This is typically the case in base-load steam turbine-generator systems which are operated at, or near, rated load for extended periods of time, such as, for example, years. Other applications for steam turbine system 10 employ less than the rated output of steam turbine 12 for substantial periods of time. For example, a steam turbine system 10 forming part of a co-generation system wherein the exhaust steam from steam turbine 12 is used as process steam in an external process and the torque output on rotor 18 is an economic by-product of the process, may operate for extended periods at a fraction of rated output. That is, the requirements of the process using the process steam from steam turbine 12 may establish the economic steam flow through steam turbine 12 at a value which is less than a steam flow sufficient to produce the rated output of steam turbine 12. Thus, a steam turbine system 10 may operate for extended periods of time at, for example, 50 or 70 percent of rated output.

Figure 2:
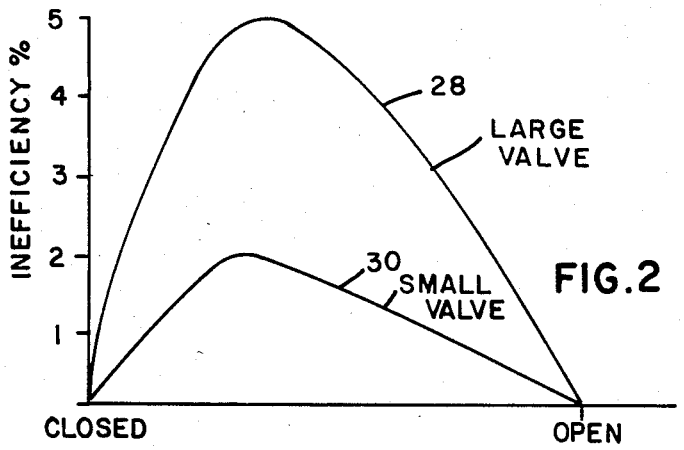
FIG. 2 is a set of curves to which reference will be made in describing the factors influencing the inefficiency of steam control valves.

The inefficiency of the individual control valves in control valve system 14 is proportional to their size and varies with the amount by which they are open. Referring to FIG. 2, for example, the inefficiency of a large valve changes in the manner shown in a curve 28 as it varies from fully closed to fully open, compared to an ideal (fully open) valve. It will be noted that the inefficiency rises to a peak intermediate the closed and open conditions. The magnitude of the peak depends on the size of the control valve. A smaller valve may produce an inefficiency curve 30 having a substantially lower peak value. Operation of a steam turbine system 10 employing a fixed-sequence mechanical valve controller under less than rated output invokes a probability that a substantial part of the operating time may be spent with one of the individual control valves opened an amount which places its inefficiency in the higher portion of curve 28. Since the fixed sequence systems of the prior art use equal-sized control valves, the advantage of using at least some smaller control valves in order to take advantage of the lower inefficiency of curve 30 is not available. The cost of control valves and their controls limit the number of control valves which can be employed. Thus, an approach which employs a larger number of smaller-sized control valves is not usually practical.

We have discovered that the availability of economical computer equipment loosens the constraints which formerly led to the fixed-sequence mechanical cam-operated control system 20. That is, analog or digital computer equipment is capable of containing a model of the valve characteristic, not only of a single valve size, but also of a variety of valve sizes over the entire load range of the system. The model valve characteristic is therefore available for making the steam flow linear with respect to a demand function. Such computer equipment is capable of directly operating the control valves in a variable sequency, by producing output signals which are capable of driving independent actuators for the individual control valves in control valve system 14. Thus, the individual control valves in control valve system 14 are provided in complementary sizes, each feeding a correspondingly sized group of nozzles, which are operated in a sequence especially effective for maintaining the output torque on rotor 18 at a predetermined level, and do so while using the smallest possible one of the individual control valves for performing the governing or modulating with all of the remainder of the control valves either fully open or fully closed. In addition, we have discovered that, since individual controllers may operate almost instantaneously, improved efficiency may be obtained by switching from a first valve combination to a second valve combination at an intermediate condition of the controlling or modulating valve without waiting for it to become fully open or fully closed.

Figure 3:
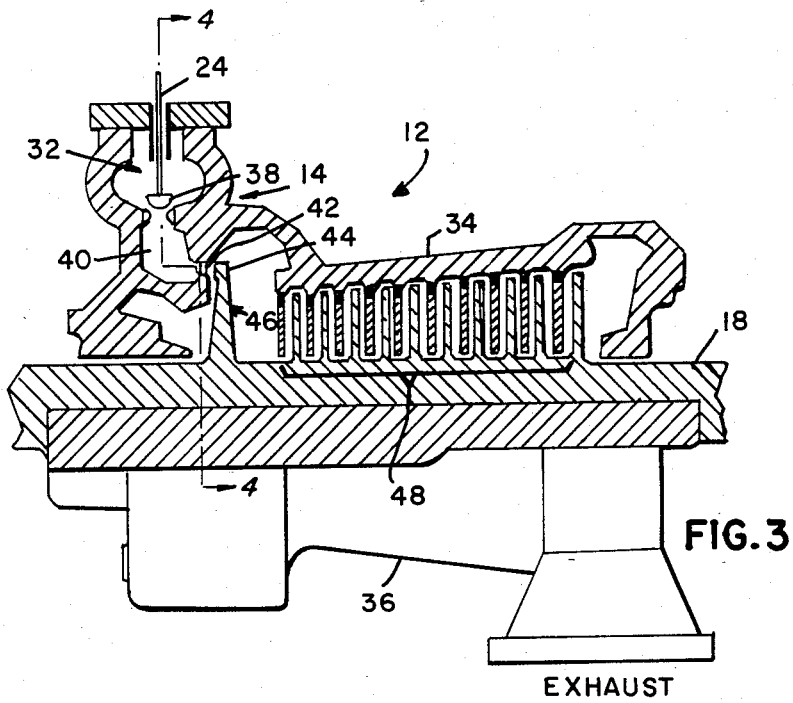
FIG. 3 is a side view of a steam turbine with the upper half thereof in cross section according to an embodiment of the invention.

Referring now to FIG. 3, an axial cross section is shown of a steam turbine 12 according to an embodiment of the invention. Steam from stop valve 16 (not shown in FIG. 3) is admitted to a steam chest 32 in an upper casing 34 of steam turbine 12. A lower part of steam turbine 12 is closed with a mating lower casing 36. In some types of steam turbine 12, the downstream portions of steam turbine 12 all receive their steam from a half annular steam chest 32 located only in upper casing 34. In other embodiments of steam turbine 12, steam chest 32 is a fully annular member extending through both upper casing 34 and lower casing 36. This difference between steam chest extent is merely a constructional detail and is not of consequence to the spirit and scope of the invention. The following detailed description is directed toward a system in which the steam is admitted through a half annular steam chest 32 in upper casing 34.

A control valve 38 of control valve system 14 is disposed between steam chest 32 and a nozzle bowl 40 which is one of a plurality of nozzle bowls, one for each control valve. A nozzle group 42, consisting of a plurality of aerodynamically shaped vanes, turn and accelerate steam from nozzle bowl 40 into impingement on buckets 44 of a control stage 46 disposed on rotor 18 and rotatable therewith. The steam passing control stage 46 is expanded, and its energy is partly absorbed, in passing through additional conventional turbine group stages 48, for applying torque to rotor 18.

Figure 4:
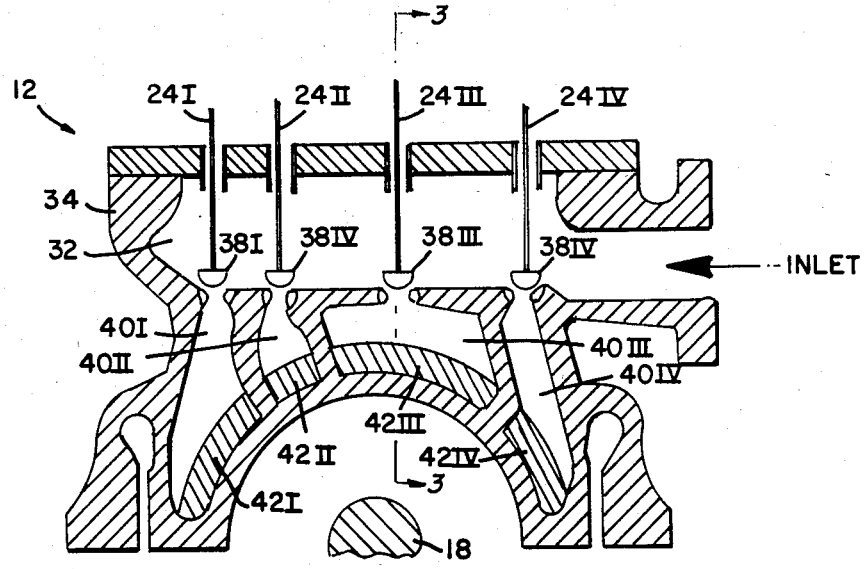
FIG. 4 is a transverse cross section taken along IV—IV in FIG. 3.

Referring now to the transverse cross section of steam turbine 12 in FIG. 4, an embodiment is shown using four control valves 38, all in upper casing 34, each feeding one nozzle bowl 40 which, in turn feeds steam to its own nozzle group 42. For convenience in description, the four control valves 38 are identified with the suffixes I, II, III and IV reading clockwise from the left. The four nozzle bowls 40 and nozzle groups 42 are similarly identified by suffix. It will be noted that the angular extent of nozzle groups 42I–42IV are unequal. That is, the angular extent of the four nozzle groups increase in the order II (smallest), IV, I and III. In the specific case using a total of 44 nozzles divided into four nozzle groups 42I–42IV, one method of apportioning the nozzles between nozzle groups 42 may be as follows:

| NOZZLE GROUP | I | II | III | IV |
|---|---|---|---|---|
| NO. NOZZLES | 12 | 6 | 17 | 9 |

The above apportionment of nozzles between nozzle groups 42I–IV is one which is calculated to optimize efficiency at a power output of about 70 percent of rated output. One skilled in the art with the present disclosure before him, would be fully enabled to perform the routine engineering calculations for a specific steam turbine 12 and for a specific target power output. Thus, the calculations leading to the apportionment of nozzles between the nozzle groups are omitted herefrom.

Since control valves 38I–IV can be operated in any sequence, certain constraints are required for maximum efficiency. In order to minimize inefficiencies due to end effects and to avoid possible resonance problems by impacting steam on buckets 44 at separated areas during its rotation, if more than one nozzle group 42 is delivering steam, each control valve 38 which is either fully or partially open must feed a nozzle group 42 which is adjacent to another nozzle group 42 also receiving steam. One such sequence for the above nozzle grouping which provides eight levels of steam delivering is given in the following tabulation:

| NOZZLES CONTROLLED | CONTROL VALVE 38I 12 | 38II 6 | 38III 17 | 38IV 9 | NOZZLES MIN-MAX |
|---|---|---|---|---|---|
| LEVEL | | | | | |
| 1 | G | CL | CL | CL | 0–12 |
| 2 | O | G | CL | CL | 12–18 |
| 3 | CL | G | O | CL | 17–23 |
| 4 | CL | CL | O | G | 17–26 |
| 5 | CL | G | O | O | 26–32 |
| 6 | O | G | O | CL | 29–35 |
| 7 | O | O | O | G | 35–44 |
| 8 | O | G | O | O | 38–44 |

Legend:
G = governing
CL = closed
O = full open

It will be noted from the above tabulation that control valve 38III, feeding the largest nozzle group 42III becomes fully opened at and above level 3 and is never used as the governing valve. That is, the largest-capacity control valve 38III, the one most capable of contributing to inefficiency if operated in a partially opened condition, is either fully open or fully closed, and is never operated at an intermediate openness. With the exception of levels 1, 4 and 7, the governing valve is always control valve 38II which is the smallest of the valves. Of the remaining levels, 4 and 7 are governed by control valve 38IV, which is the second-smallest valve. A control sequence could be adopted to split level 1 into portions involving smallest control valve 38II and second-smallest control valve 38IV as the governing valves. From a practical standpoint, however, the use of only six, nine or even 12 nozzles over a sustained period is highly unlikely. Thus, level 1 is unlikely to be used except during acceleration and loading or deceleration and unloading of steam turbine 12 through the speed or torque range associated therewith on its way toward or from some higher operating point and the inefficiency added by the recited sequence may be negligible. The additional complexity of creating one or more additional levels may therefore be unwarranted but its use should not be considered to avoid the scope of the invention.

Figure 5:
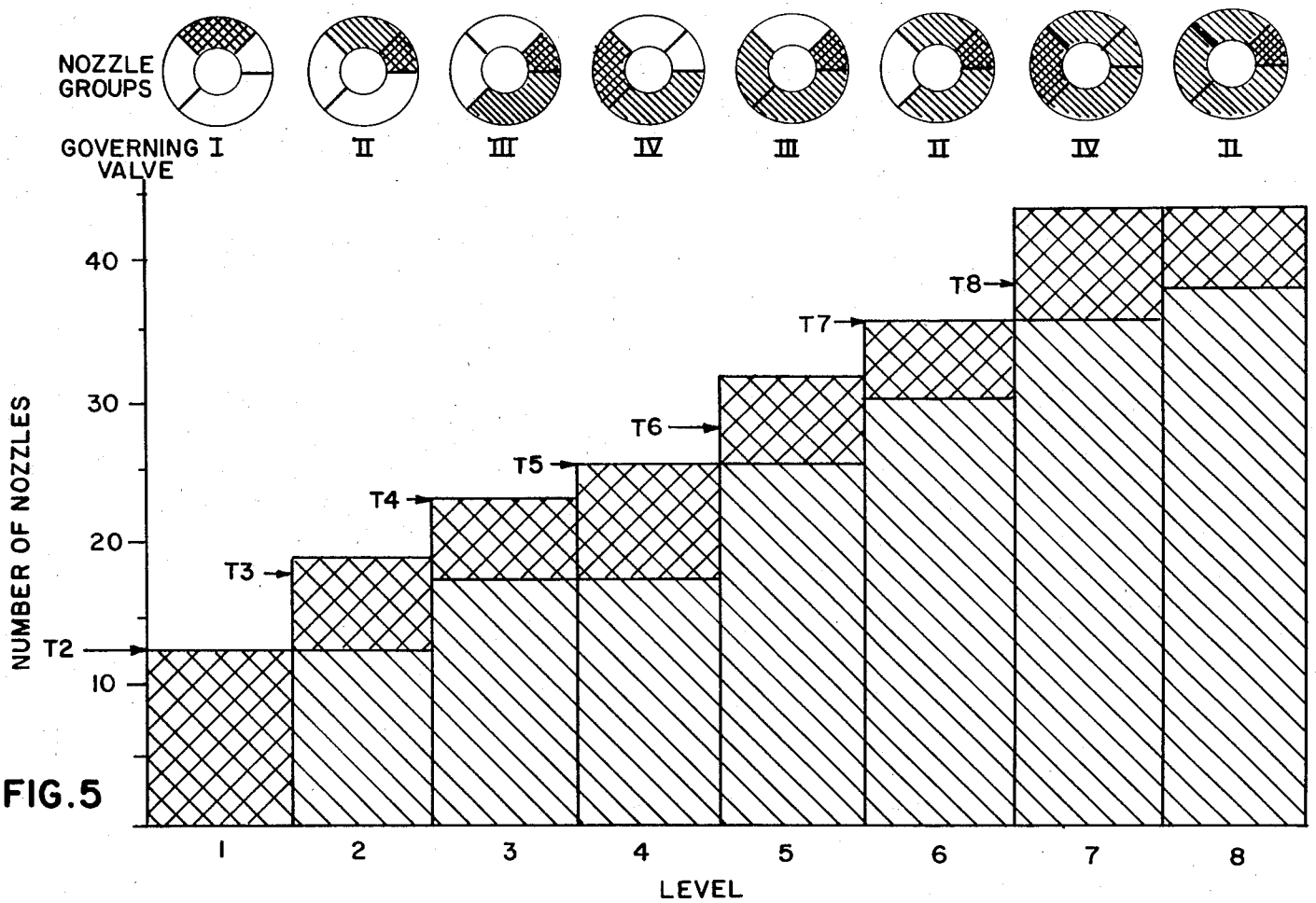
FIG. 5 is a graphic representation of the steam flow in the embodiment of the invention of FIGS. 3 and 4.

Referring now to FIG. 5, there is shown a graphic representation of the nozzle data in the above tabulation. In the histogram portion, the number of nozzles involved in governing at each level is shown cross-hatched and the number of nozzles which are fully open are shown hatched. In the portion above the histogram, a similar convention is employed to illustrate that, at every level where more than one nozzle group is supplying steam, each nozzle group supplying steam is adjacent to another nozzle group supplying steam.

Other sets of sizes for nozzle groups 42 may be selected with appropriate adjustment of transition points and valve characteristic models. For example, in addition to the sizes of nozzle groups 42 in the foregoing example, the following additional sets of nozzle groups 42 (in terms of number of nozzles) may be used in a system having a total of 44 nozzles:

(1) 6, 8, 13 and 17
(2) 5, 9, 13 and 17
(3) 7, 8, 12 and 17

It would be clear that a system having more or less than 44 nozzles must have its nozzles integrally divided among suitable nozzle groups 42 and that the steam flow to such nozzles must be controlled in a manner consistent with the present disclosure to improve the efficiency of the system. One skilled in the art, with the present disclosure before him, would be fully enabled to perform such division and to control the steam flow to the resulting nozzle groups 42.

The options available for nozzle groupings and the control combinations for supplying steam to them increase substantially in a system in which steam is admitted through an entire annulus of nozzles, rather than through the half annulus of the foregoing description. The increase in options arises because the limitations imposed by the desirability of adjacency in all nozzle groups 42 delivering steam is simplified when the ends of the arc formed by nozzle groups 42 in the above example are eliminated.

As previously noted, an optimum operational path may be used for operating control valves 38I–IV which further improves the efficiency over that provided by complementary sizing of control valves 38I–IV and selecting a sequence for operation of such valves. The adjacency requirement is not necessarily a dominant requirement. Combinations of nozzle groups 42 and valve sequences may be discovered which provide improved efficiency using steam supplied through combinations of non-adjacent nozzle groups 4. The use of such non-adjacent nozzle groups 42 should not therefore be considered to avoid the scope of the present invention. It may also be possible to vary the areas of individual nozzles in nozzle groups 42 more finely to control the efficiency improvement.

Figure 6:
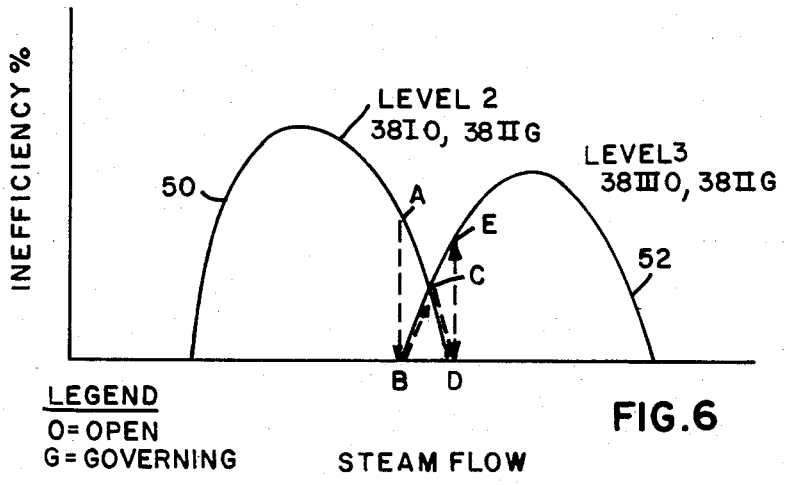
FIG. 6 is a curve showing an optimum efficiency path taken by the control system of the invention.

Referring to FIG. 6, a portion of the inefficiency curves covering levels 2 and 3 in the example case are shown. The level-2 curve 50, produced with control valve 38I open and control valve 38II governing, crosses over the level-3 curve 52, produced with control valve 38III open and control valve 38II governing, at a crossover point C. However, it should be noted that point A on level-2 curve 50 occurs at the same value of steam flow as point B on level-3 curve 52. Furthermore, point A is located at a high inefficiency whereas point B is near optimum. Advantage is taken of an improvement in efficiency offered by this phenomenon in control system 20 (FIG. 1) of our invention. That is, when point A is reached, control valves 38I and II are rapidly closed and control valve 38III is fully opened. If operation remains at point B, it has the advantage of the optimum efficiency provided by the valve condition at that point rather than suffering the inefficiency at point A. As the need for additional steam flow occurs, level-3 curve 52 is followed from point B only as far as crossover point C. Beyond point C, the efficiency along level-2 curve 50 is better than that found by following level-3 curve 52. Thus, control system 20 is programmed to transfer to level-2 curve 50 by closing control valve 38III, fully opening control valve 38I and partially opening control valve 38II to attain the condition at point C, and thereafter to follow level-2 curve 50 from point C to point D. Beyond point D, control valve 38I and control valve 38II are incapable of supplying a sufficient steam flow. Thus, additional steam flow is obtained by resuming operation of level-3 curve 52 at point E. The path ABCDE followed is traced in dashed lines.

Additional crossovers similar to the above occur at higher levels and are traversed in the same way by choosing the valve combinations giving the greatest efficiency.

Other apportionments of nozzles into nozzle groups may also be performed. For example, nozzle groups having 4, 4, 8, 16 and 32 nozzles can be operated in a fashion which never requires more than 4 nozzles to be involved in governing; the remainder are fully open or fully closed. In larger machines, standard sizes of control valves having a capacity large enough to supply a large nozzle group may be unattainable or uneconomical. Since the present invention permits independent valve operation, two or more smaller control valves may be gang operated by the same control signal to obtain a result equivalent to a single valve of twice the capacity.

Figure 7:
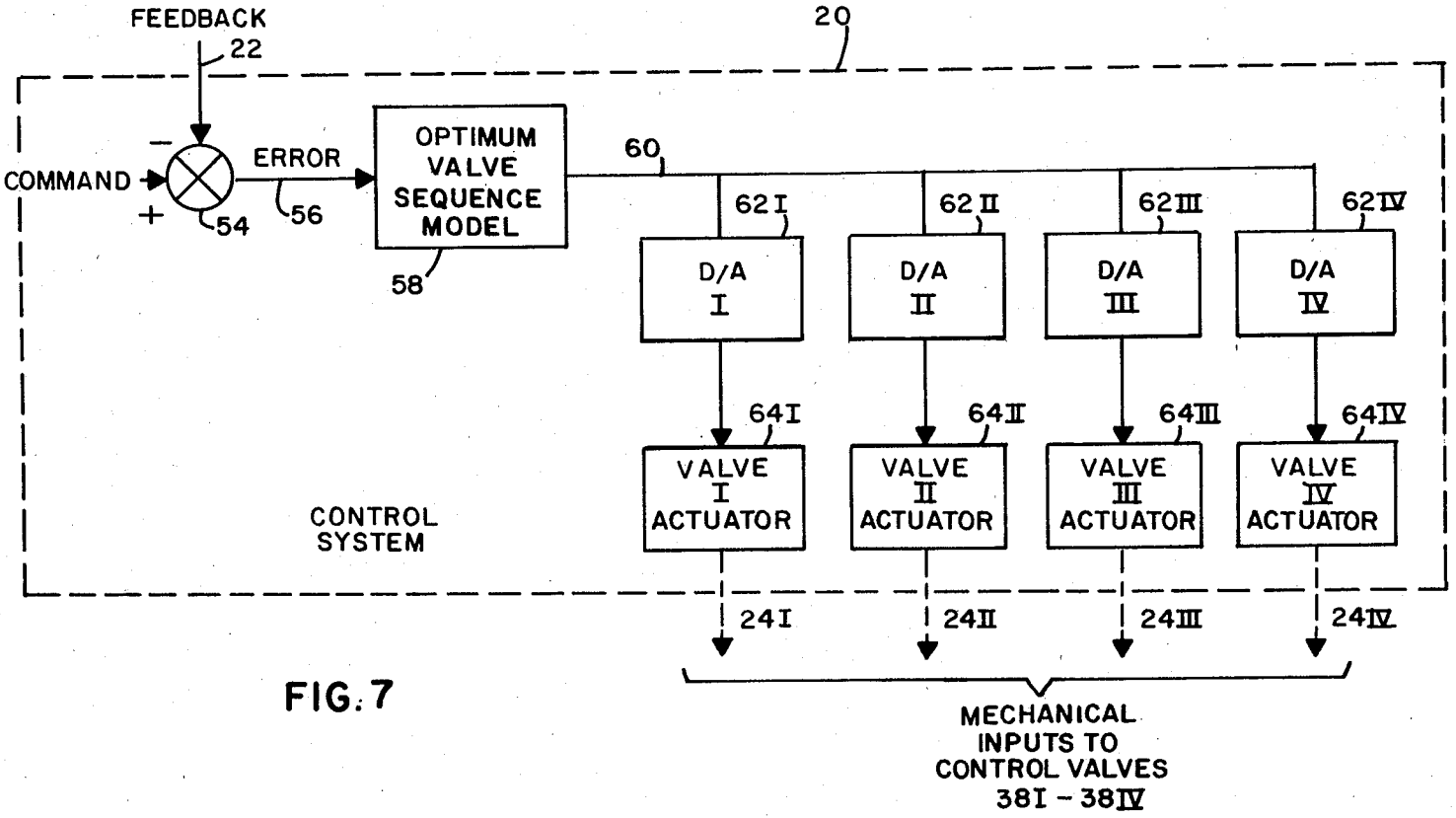
FIG. 7 is a block diagram of the control system of FIG. 1.

Referring now to FIG. 7, there is shown an embodiment of control system 20. The feedback signal on line 22, which may be any suitable signal representing a steam flow, a speed, a temperature and/or pressure, a voltage produced by a generator load or a phase of a generated electricity, is applied to a minus input of a summing junction 54. A command signal, representing the desired value of the parameter on line 22 is fed to a plus input of summing junction 54. The difference between the two inputs to summing junction 54, representing the error in the controlling parameter, is applied on a line 56 to an optimum valve sequence model 58. Optimum valve sequence model 58 contains data corresponding to that previously discussed herein relating a required steam flow to a valve sequence and a required valve condition of openness. The data may be contained in optimum valve sequence model 58 in any convenient form such as, for example, in sets of equations and the like. In the preferred embodiment, however, optimum valve sequence model 58 contains data in one or more lookup tables which it refers to for selecting values for the condition of the four control valves 38I–38IV. That is, optimum valve sequence model 58 contains at least one lookup table having sets of values with a one-to-one correspondence between a required steam flow and a required set of optimum-efficiency valve conditions to obtain the required flow. In some applications, it may be uneconomic to store a field of data points sufficiently dense to cover all possible operating conditions. It may be more economical to store data at a lower density and to use linear or non-linear interpolation between the nearest adjacent pair of data to arrive at the required output signals. Since one skilled in the art is fully aware of the method by which such data is stored, retrieved and interpolated, a more complete description of the apparatus for doing so would be redundant and is omitted herefrom.

The digital outputs of optimum valve sequence model 58 are applied on a line 60 to inputs of digital to analog converters 62I–62IV which convert the digital commands representing valve positions in their analog equivalents. The analog valve-position commands are applied to valve actuators 64I–64IV which may be, for example, conventional hydraulic actuators responsive to their analog input signals to produce corresponding mechanical outputs on line 24I–24IV for direct actuation of control valves 38I–38IV.

Control system 20 may be implemented in any convenient type of hardware, such as, for example, in digital, analog or hybrid digital/analog computers. Such implementation may employ discrete components or integrated circuits at any level of integration. If a digital implementation is employed, at least some of the functions of control system 20 may be performed on a mainframe, minicomputer or a microcomputer. In the preferred embodiment, a microcomputer is employed to perform at least some of the functions of optimum valve sequence model 58. The command signal fed to summing junction 54 may be a fixed value or it may be a varying value selected by a human operator on a control panel (not shown) or may be automatically selected in response to an internal or external stimulus.

Although the foregoing description is directed to the use of the invention in a straight, non-condensing steam turbine, one skilled in the art woudl recognize that the invention is equally applicable to all turbines employing a plurality of control valves admitting a compressible fluid to a turbine stage including, for example, condensing turbines, extraction turbines or one or more stages in a combined turbine system.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A turbine system comprising:

a turbine;

a control valve system for feeding a compressible fluid to said turbine including at least first, second and third control valves for independently controlling admission of said compressible fluid to respective first, second and third nozzle groups in said turbine; said first nozzle group having a substantially smaller number of nozzles than either of said second or third nozzle groups; said second nozzle group having a number of nozzles intermediate the number of nozzles in said first and third nozzle groups; and, the sum of the nozzles in the first and second nozzle groups containing at least as many nozzles as said third nozzle group; and, a control system including means for producing first, second and third independent control signals for respectively positioning said first control valve in a governing position while independently controlling said second and third control valves in fully open or fully closed positions; whereby transfer is made from a first condition in which said second control valve is fully open and said third control valve is fully closed while said first control valve is partly open to a second condition supplying the same amount of said compressible fluid to said turbine in which said first and second control valves are fully closed and said third control valve is fully open to provide improved operating efficiency.

* * * * *